US008882928B2

(12) United States Patent
Kim et al.

(10) Patent No.: US 8,882,928 B2
(45) Date of Patent: Nov. 11, 2014

(54) METHOD FOR CONTROLLING DISHWASHER

(75) Inventors: Minchul Kim, Seoul (KR); Kyuhyung Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 152 days.

(21) Appl. No.: 13/215,811

(22) Filed: Aug. 23, 2011

(65) Prior Publication Data

US 2012/0055511 A1 Mar. 8, 2012

(30) Foreign Application Priority Data

Sep. 2, 2010 (KR) ..... 10-2010-0086018

(51) Int. Cl.

*B08B 7/04* (2006.01)
*A47L 15/00* (2006.01)
*A47L 15/42* (2006.01)

(52) U.S. Cl.

CPC ..... *A47L 15/0049* (2013.01); *A47L 2401/20* (2013.01); *A47L 2501/05* (2013.01); *A47L 2401/22* (2013.01); *A47L 15/0031* (2013.01); *A47L 15/4208* (2013.01)

USPC ..... 134/10; 134/18; 134/22.1; 134/42; 134/56 D; 134/57 D; 134/58 D; 134/109; 134/110; 134/111

(58) Field of Classification Search

USPC ..... 134/10, 18, 22.1, 42, 56 D, 57 D, 58 D, 134/109, 110, 111

See application file for complete search history.

(56) References Cited

U.S. PATENT DOCUMENTS

| | | | | |
|---|---|---|---|---|
| 3,810,480 | A * | 5/1974 | Smith et al. | 134/104.1 |
| 5,711,325 | A * | 1/1998 | Kloss et al. | 134/104.1 |
| 6,782,899 | B2 * | 8/2004 | Kim et al. | 134/104.1 |
| 2005/0263174 | A1 * | 12/2005 | Yoon et al. | 134/104.1 |
| 2006/0207632 | A1 | 9/2006 | Lee | |
| 2009/0032061 | A1 * | 2/2009 | Beer et al. | 134/18 |
| 2011/0126855 | A1 * | 6/2011 | Pyo et al. | 134/10 |
| 2011/0197934 | A1 * | 8/2011 | Fueglein et al. | 134/111 |
| 2011/0232702 | A1 * | 9/2011 | Fauth et al. | 134/56 D |

FOREIGN PATENT DOCUMENTS

| | | | |
|---|---|---|---|
| DE | 10 2008 055 022 | A1 | 6/2010 |
| EP | 0 998 872 | A1 | 5/2000 |
| EP | 1 649 797 | A1 | 4/2006 |
| KR | 10-2006-0101086 | A | 9/2006 |
| KR | 10-0686096 | B1 | 2/2007 |

* cited by examiner

*Primary Examiner* — Bibi Carrillo
(74) *Attorney, Agent, or Firm* — Birch, Stewart, Kolasch & Birch, LLP

(57) ABSTRACT

Provided is a method of controlling a dishwasher. The dishwasher includes a washing chamber accommodating a dish, a sump storing washing water, and supplying the washing water to the washing chamber, and a filter part provided to the sump, and filtering a foreign substance from the washing water. In the method, a first pump is driven to perform a washing or rinsing process, the first pump is stopped and a second pump is driven for a first set time to perform a discharging process, after the washing or rinsing process, the second pump is stopped and the first pump is driven for a second set time, and the first and second pumps are stopped.

11 Claims, 8 Drawing Sheets

METHOD FOR CONTROLLING DISHWASHER

CROSS-REFERENCE TO RELATED APPLICATIONS

The present application claims priority under 35 U.S.C. 119 to Korean Patent Application No. 10-2010-0086018 filed on Sep. 2, 2010, which is hereby incorporated by reference in its entirety.

BACKGROUND

The present disclosure relates to a dishwasher and a method of controlling the dishwasher.

Dishwashers spray washing water to a dish to remove leftover food or food waste from the dish.

Such a dishwasher includes a sump at a side of a washing chamber to receive clean washing water, and a washing water sprayer to spray washing water to dishes within the washing chamber, thereby washing the dishes. The washing water used for washing the dishes is recovered to the sump, and then, is supplied again to the washing water sprayer through a filter device within the sump.

When the washing of the dishes is completed, all of the washing water is discharged from the washing chamber and the sump. At this point, a foreign substance filtered by the filter device may be discharged together with the washing water out of the dishwasher.

However, while dishes are washed, foreign substances are continually stacked on the filter device, thereby clogging the filter device.

Furthermore, foreign substances stacked on the filter device function as a resistance against a flow of washing water passing through the filter device, to thereby decrease a flow rate of the washing water. As a result, the amount of washing water supplied to the washing water sprayer is reduced, and thus, washing performance of the dishwasher is degraded, and an overload is applied to a washing water pump unit for pumping washing water.

In addition, since foreign substances continually stacked on the filter device stick to at least one surface of a filter, removal of the foreign substance may be difficult, and a foreign substance may decay to generate offensive smell in the washing chamber.

SUMMARY

Embodiments provide a dishwasher that prevents clogging of a filter by a foreign substance.

Embodiments also provide a dishwasher that controls an operation of a washing water pump or discharging pump to remove a foreign substance from a filter.

In one embodiment, a method of controlling a dishwasher including: a washing chamber accommodating a dish; a sump storing washing water, and supplying the washing water to the washing chamber; and a filter part provided to the sump, and filtering a foreign substance from the washing water, includes: driving a first pump to perform a washing or rinsing process; stopping the first pump and driving a second pump for a first set time to perform a discharging process, after the washing or rinsing process; stopping the second pump and driving the first pump for a second set time; and stopping the first and second pumps.

In another embodiment, a dishwasher includes: a washing chamber accommodating a dish; a sump disposed under the washing chamber, and storing washing water; a filter part provided to the sump, and filtering a foreign substance from the washing water; a washing water pump disposed at a side of the filter part, and providing driving force to circulate the washing water within the washing chamber and the sump; a discharging pump disposed at another side of the filter part, and providing driving force to discharge the washing water out of the dishwasher; and a control part controlling driving of the washing water pump or the discharging pump to wash or rinse the dish accommodated in the washing chamber or to discharge the washing water, wherein the control part controls the washing water pump and the discharging pump to be turned on/off a preset number of times after the washing or rinsing of the dish is completed before the washing water is discharged.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
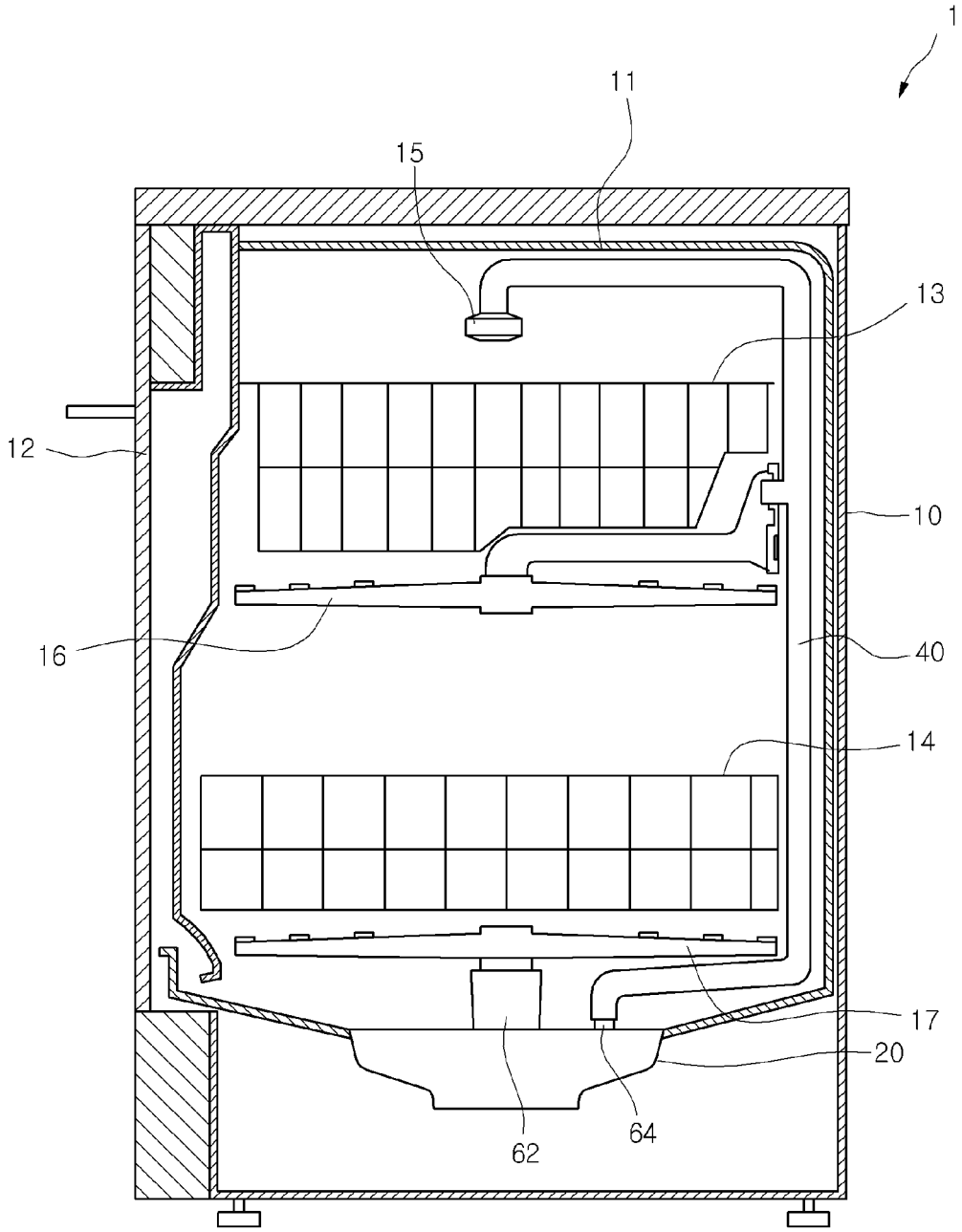
FIG. 1 is a cross-sectional view illustrating a dishwasher according to an embodiment.

FIG. 1 is a cross-sectional view illustrating a dishwasher according to an embodiment.

Referring to FIG. 1, a dishwasher 1 according to the current embodiment includes: a case 10 forming an appearance of the dishwasher 1; a tub 11 disposed in the case 10 to form a washing chamber; a door 12 provided to the front surface of the tub 11 to open and close the washing chamber; and a sump 20 disposed under the tub 11 to store washing water.

An upper rack 13 and a lower rack 14, which accommodate dishes, are disposed in the tub 11. The upper rack 13 is spaced a predetermined distance upward from the lower rack 14. The upper rack 13 and the lower rack 14 are guided by guide rails (not shown) disposed on inner surfaces of the tub 11, so that the upper rack 13 and the lower rack 14 can be drawn to the front side from the tub 11.

A top nozzle 15, an upper nozzle 16, and a lower nozzle 17 are disposed over the sump 20 to spray washing water from the sump 20 into the washing chamber.

In detail, the lower nozzle 17 is coupled to the top surface of the sump 20 to spray washing water to the lower portion of the washing chamber, and the sprayed washing water is directed to a dish in the lower rack 14. The sump 20 is provided with a lower nozzle coupling part 62 coupled to the lower nozzle 17.

The upper nozzle 16 is disposed in the middle of the washing chamber to spray washing water to the upper rack 13. The top nozzle 15 is disposed at a ceiling of the tub 11 to spray washing water downward.

The washing water guide 40 is disposed over the sump 20 to guide washing water from a washing water pump. The washing water guided through the washing water guide 40 may be sprayed to the upper rack 13 through the top nozzle 15 or the upper nozzle 16. The sump 20 is provided with a guide connection 64 coupled to the washing water guide 40.

Figure 2:
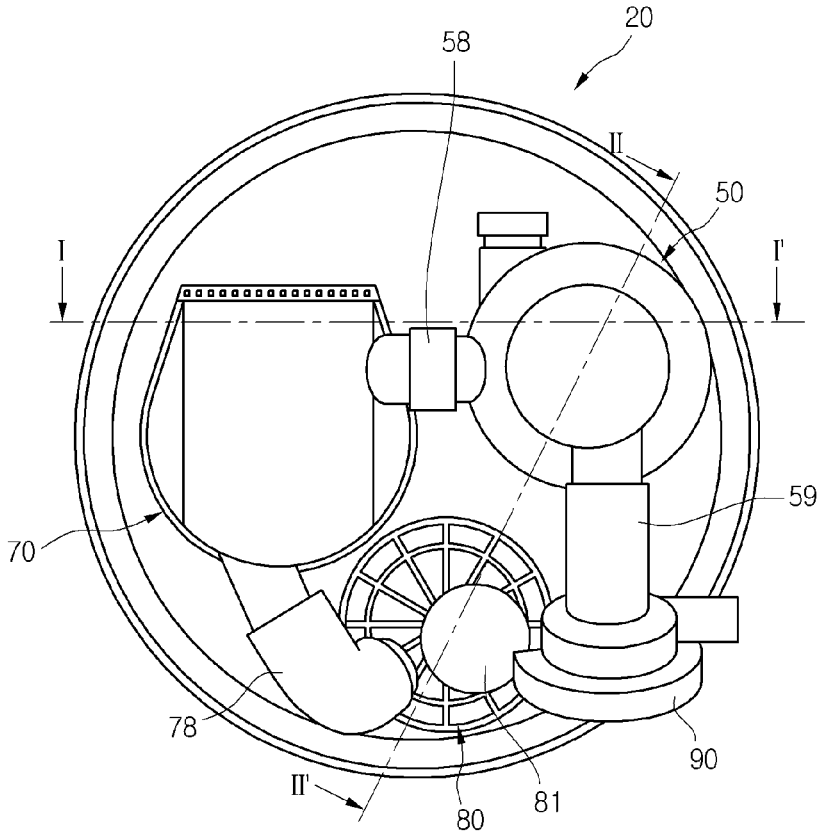
FIG. 2 is a bottom view illustrating a sump according to an embodiment.
Figure 3:
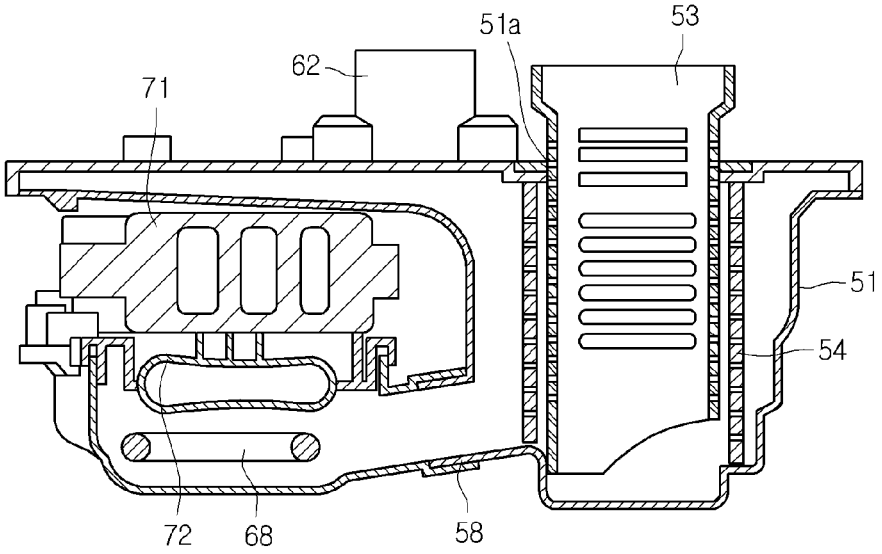
FIG. 3 is a cross-sectional view taken along line I-I' of FIG. 2.
Figure 4:
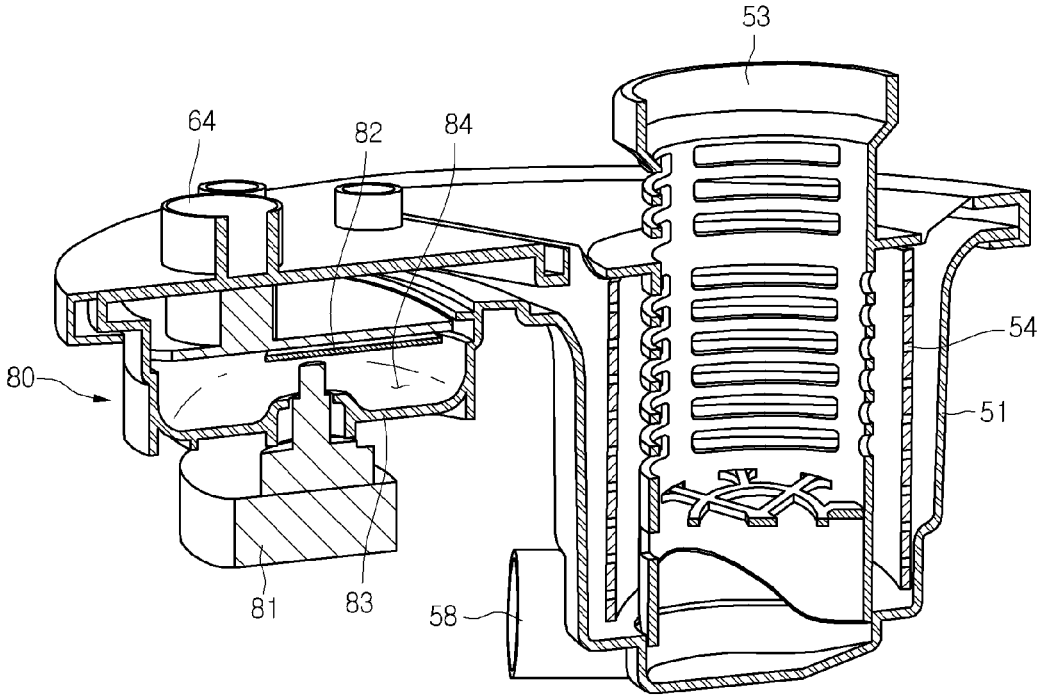
FIG. 4 is a cut-away perspective view taken along line II-II' of FIG. 2.
Figure 5:
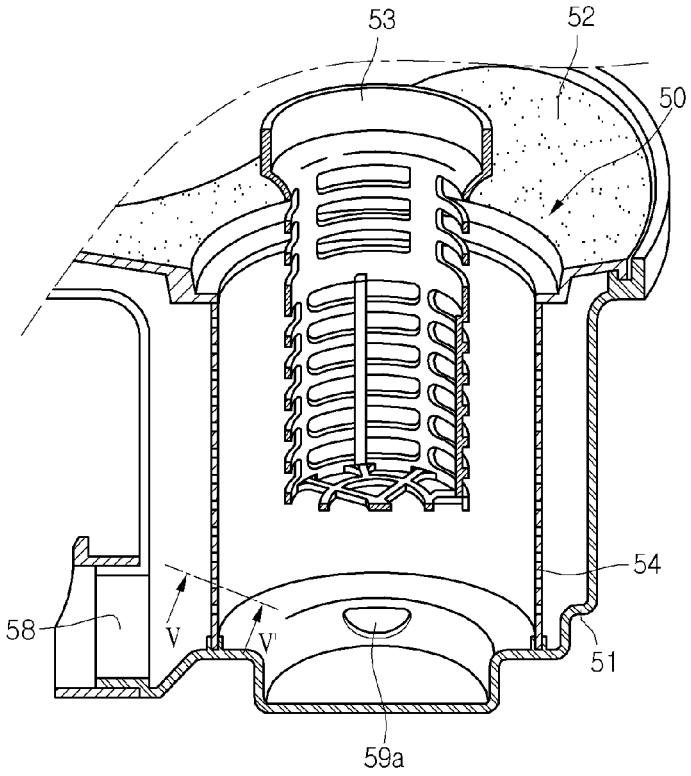
FIG. 5 is cut-away perspective view illustrating a filter part according to an embodiment.

FIG. 2 is a bottom view illustrating a sump according to the current embodiment. FIG. 3 is a cross-sectional view taken along line I-I' of FIG. 2. FIG. 4 is a cut-away perspective view taken along line II-II' of FIG. 2. FIG. 5 is cut-away perspective view illustrating a filter part according to the current embodiment.

Referring to FIGS. 2 to 5, the sump 20 includes: a filter part 50 filtering a foreign substance from washing water after washing a dish in the tub 11; a washing water pump 70 pumping the washing water from the filter part 50; and a passage opening-closing part 80 switching or opening-closing passages to move the washing water from the washing water pump 70 to the lower nozzle 17 or the washing water guide 40.

In detail, the filter part 50 includes: a first filter 52 constituting a lower end of a washing space of the tub 11 and including holes having a first size; a second filter 53 disposed in the sump 20 and including holes having a size greater than the first size; and a third filter 54 disposed in the sump 20 and including holes having a size smaller than the first size. The first filter 52 is provided to a portion of the top surface of the sump 20.

Further, the filter part 50 includes a filter housing 51 accommodating the second and third filters 53 and 54.

While washing water is introduced to the filter housing 51, the washing water is primarily purified through the first filter 52, and is secondarily and thirdly purified through the second and third filers. A foreign substance filtered by the first filter 52 is positioned at the upper end of the sump 20.

A filter introduction part 51*a* is disposed over the filter housing 51 to introduce washing water to the filter part 50. The second and third filters 53 and 54 filter a foreign substance from washing water introduced into the filter housing 51 through the filter introduction part 51*a*.

A pump introduction part 58 is disposed at a side of the lower portion of the filter housing 51 to introduce purified washing water to the washing water pump 70. Washing water stored in the sump 20 may be moved through the filter part 50 to the pump introduction part 58 by suction force of the washing water pump 70.

The washing water pump 70 includes a washing water motor 71 for providing driving force, and an impeller part 72 rotated by the driving force of the washing water motor 71. The impeller part 72 may be disposed under the washing water motor 71.

A pump discharge part 78 is disposed at a side of the washing water pump 70 to discharge washing water from the washing water pump 70.

Washing water is introduced to the impeller part 72 through the pump introduction part 58, and is discharged via the impeller part 72 through the pump discharge part 78.

A heater 68 is disposed at a side of the washing water pump 70 to heat flowing washing water. Since washing water for washing a dish is heated to high temperature by the heater 68, washing efficiency is improved. The heater 68 may be disposed under the impeller part 72.

The pump discharge part 78 is connected to the passage opening-closing part 80. The passage opening-closing part 80 includes: an opening-closing valve 82 opening and closing the passages for washing water; and an opening-closing driving part 81 driving the opening-closing valve 82.

Washing water introduced to the passage opening-closing part 80 may be moved through the opening-closing valve 82 to the lower nozzle coupling part 62 or the guide connection 64.

That is, washing water may be moved to the lower nozzle coupling part 62 by an operation of the opening-closing valve 82, so that the washing water can be moved to the lower nozzle 17. On the contrary, washing water to be moved to the upper nozzle 16 or the top nozzle 15 may be moved to the guide connection 64.

The washing water guide 40 may include passages communicating with the top nozzle 15 or the upper nozzle 16, that is, a top nozzle passage (not shown) and an upper nozzle passage (not shown). Washing water may be moved to the top nozzle passage and the upper nozzle passage by controlling the opening-closing valve 82.

The top nozzle 15, the upper nozzle 16, and the lower nozzle 17 may be selectively opened to spray washing water through one of the top nozzle 15, the upper nozzle 16, and the lower nozzle 17. Alternatively, all of the top nozzle 15, the upper nozzle 16, and the lower nozzle 17 are opened to spray washing water through all of the top nozzle 15, the upper nozzle 16, and the lower nozzle 17.

A discharging pump 90 providing suction force for discharging washing water, and a discharging part 59 disposed between the filter part 50 and the discharging pump 90 to discharge washing water and a foreign substance are disposed at a side of the filter part 50.

A discharging hole 59*a* for discharging washing water is disposed in the lower portion of the filter housing 51. When the discharging pump 90 is driven, washing water stored in the sump 20 and a foreign substance remaining in the filter part 50 are discharged through the discharging hole 59*a*. The washing water discharged through the discharging hole 59*a* may be discharged out of the dishwasher 1 through the discharging part 59 and the discharging pump 90.

The passage opening-closing part 80 includes a case 83 storing washing water introduced through the washing water pump 70. The case 83 defines a washing water storage 84 for storing washing water.

Operations of a dishwasher configured as described above will now be described.

The dishwasher 1 may perform a preliminary washing process, a main washing process, a rinsing process, a hot rinsing process, a drying process.

The preliminary washing process is a process of removing a protein-based waste before the main washing process. The main washing process uses heated washing water and a detergent. The rinsing processes including the hot rinsing process are processes of removing leftovers or a detergent from a dish. Washing water may be supplied and discharged between the preliminary washing process and the main washing process, between the main washing process and the rinsing process, and between the rinsing process and the hot rinsing process.

Supplied washing water is stored in the sump 20. Then, when the washing water pump 70 is driven, the washing water may be simultaneously or selectively sprayed to the top nozzle 15, the upper nozzle 16, and the lower nozzle 17 through the washing water pump 70 and the passage opening-closing part 80.

The sprayed washing water washes dishes in the upper rack 13 and the lower rack 14, is stored again in the sump 20, and is moved to the filter part 50 by the suction force of the washing water pump 70 to filter a foreign surface. Then, the washing water purified by the filtering may be sprayed again into the washing chamber of the tub 11 through the washing water pump and the passage opening-closing part 80. This washing procedure may be repeated several times.

Figure 6:
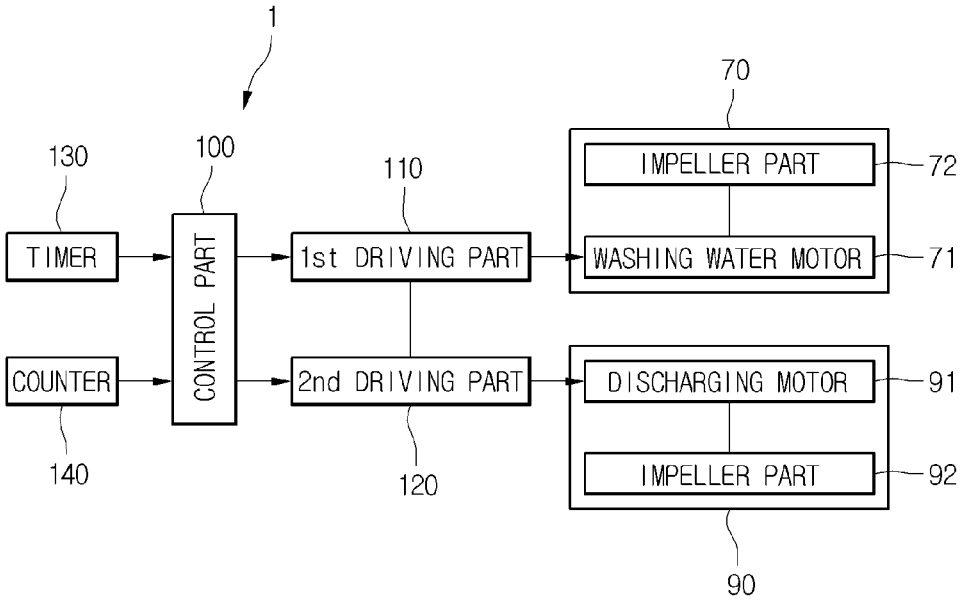
FIG. 6 is a block diagram illustrating a dishwasher according to an embodiment.
Figure 7:
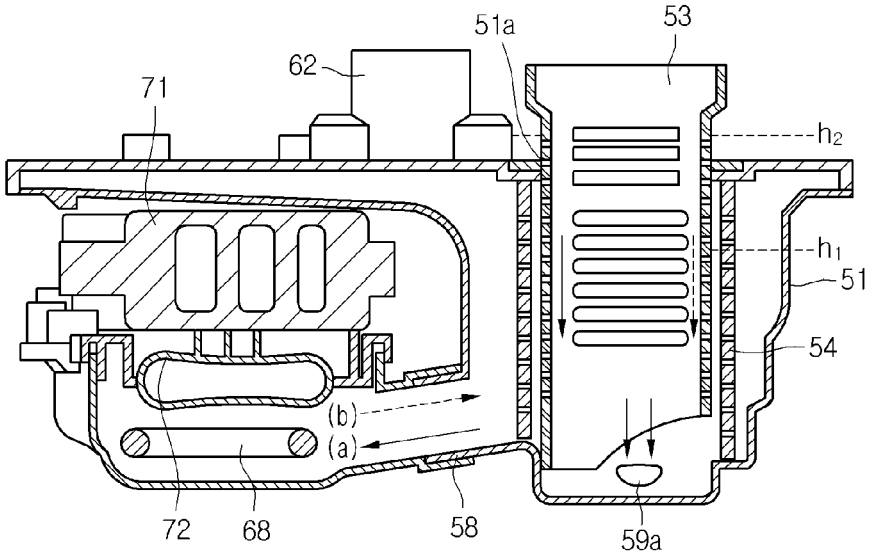
FIG. 7 is a cross-sectional view illustrating a process of adjusting a water level in a filter part of the dishwasher of FIG. 6.

FIG. 6 is a block diagram illustrating a dishwasher according to an embodiment. FIG. 7 is a cross-sectional view illustrating a process of adjusting a water level in a filter part of the dishwasher of FIG. 6.

Referring to FIGS. 6 and 7, a dishwasher 1 according to the current embodiment includes the washing water pump 70 for providing driving force to circulate washing water, and the discharging pump 90 for providing driving force to discharge the washing water after washing a dish. The washing water pump 70 and the discharging pump 90 may be referred to as a first pump and a second pump, respectively.

As described above, the washing water pump 70 includes the washing water motor 71 and the impeller part 72. The discharging pump 90 includes a discharging motor 91 and an impeller part 92.

The dishwasher 1 includes a first driving part 110 for driving the washing water motor 71, a second driving part 120 for driving the discharging motor 91, and a control part 100 controlling the dishwasher 1 to perform a preset course, that is, a washing or rinsing process.

In detail, the control part 100 may transmit a control signal to the first driving part 110 or the second driving part 120, to thereby drive the washing water motor 71 or the discharging motor 91.

Further, the dishwasher 1 includes a timer 130 for measuring a driving time of the first driving part 110 or the second driving part 120, that is, a driving time of the washing water motor 71 or the discharging motor 91, and a counter 140 for counting the number of on/off cycles of the washing water motor 71 or the discharging motor 91.

The control part 100 may control on/off operations of the washing water motor 71 or the discharging motor 91, based on information measured by the timer 130 or the counter 140. Alternatively, the timer 130 may be integrally formed with the counter 140.

Referring to FIG. 7, the washing water pump 70 or the discharging pump 90 is driven to adjust the level of washing water accommodated in the sump 20, particularly, in the filter housing 51.

When the discharging pump 90 is driven, washing water and a foreign substance are discharged outward through the discharging hole 59*a*. Thus, at this point, a water level in the filter part 50 is lower than a water level measured before the discharging pump 90 is driven.

When the washing water pump 70 is driven, suction force of the washing water pump 70 moves washing water in a direction (a) toward the heater 68, and moves washing water stored within the filter housing 51, to the lower side. Accordingly, a water level in the filter part 50 is decreased.

When the washing water pump 70 is driven, the surface of washing water is disposed at a level h1. The level h1 may be disposed between the upper end and the lower end of the filter housing 51. In other words, the level h1 may be disposed between the top and the bottom of the sump 20.

When the washing water pump 70 is stopped, the washing water moved toward the washing water pump 70 flows backward in a direction (b), and the washing water stored within the filter housing 51 moves upward. Accordingly, a water level in the filter part 50 is increased.

This is because potential energy of the washing water moved to the lower nozzle 17 or the washing water guide 40 by the washing water pump 70 is applied to the washing water after the washing water pump 70 is stopped.

When the washing water pump 70 is stopped, the surface of the washing water is disposed at a level h2 (backflow level). The level h2 is higher than the level h1, and may be at least a height corresponding to the upper end of the filter housing 51. In other words, the level h2 may be defined as a height equal to or greater than that of the top surface of the sump 20.

When the surface of the washing water is disposed at the level h2 by the stopping of the washing water pump 70, since the level h2 is over the first filter 52, a foreign substance (contaminant) trapped in the first filter 52 may float over the first filter 52. That is, the foreign substance may be removed from the first filter 52. While the level of the washing water is decreased by driving of the discharging pump 90, the foreign substance may be moved into the filter housing 51.

When the washing water pump 70 is driven, a foreign substance may be filtered by the filter part 50. When the discharging pump 90 is driven, the foreign substance may be discharged together with washing water.

When the discharging pump 90 is driven, the surface of the washing water in the filter housing 51 is lowered, and thus, may be at the level h1 that is lower than the upper end of the filter housing 51. When the discharging of the washing water is completed, the level of the washing water may be close to the lower end of the filter housing 51.

A method of controlling a dishwasher configured as described above will now be described with reference to the accompanying drawing.

Figure 8:
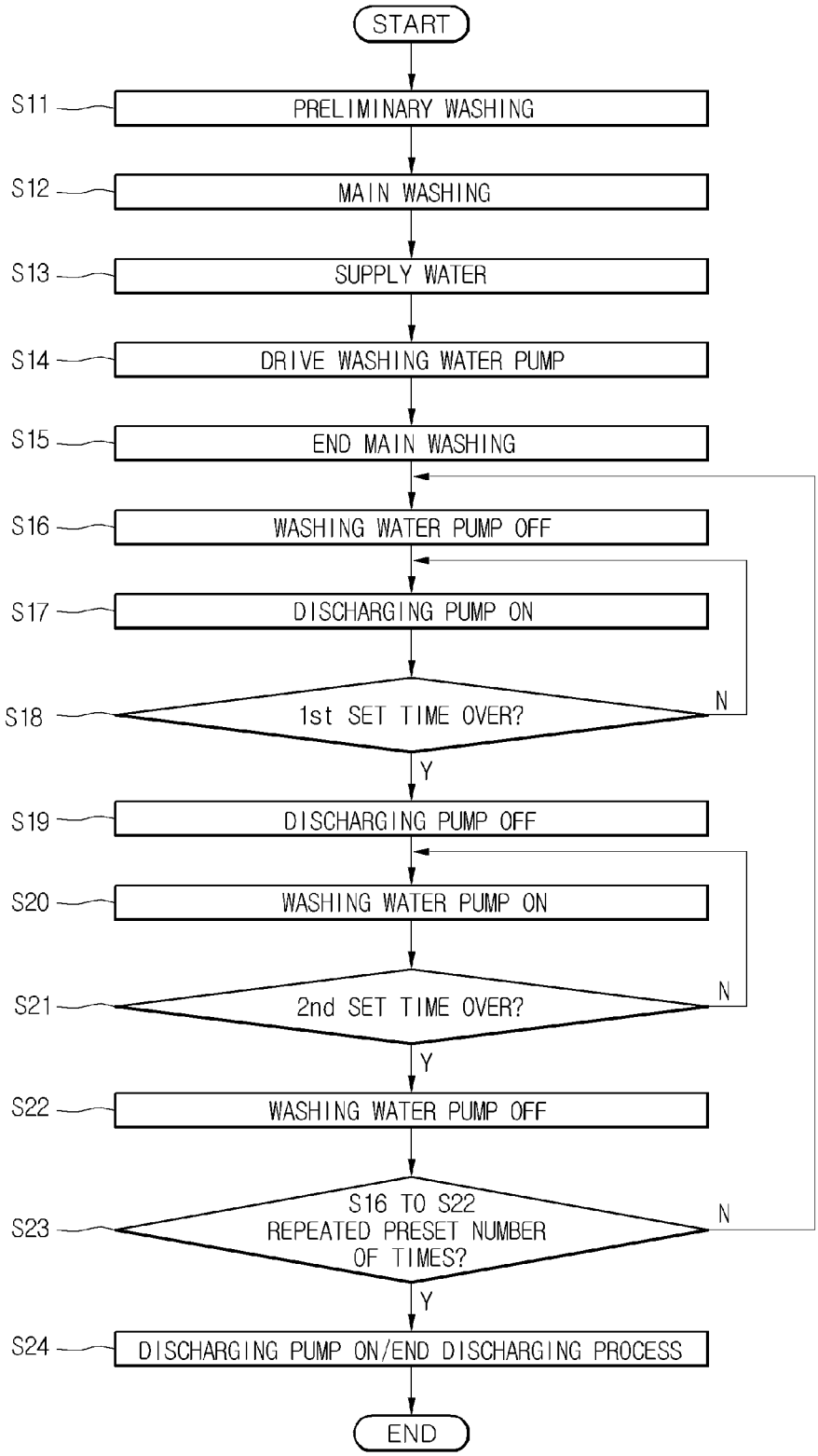
FIG. 8 is a flowchart illustrating a method of controlling a dishwasher according to an embodiment.

FIG. 8 is a flowchart illustrating a method of controlling a dishwasher according to an embodiment. Referring to FIG. 8, a method of controlling the washing water pump 70 and the discharging pump 90 in a discharging process after a washing process will now be described.

In particular, a method of controlling the washing water pump 70 and the discharging pump 90 in a discharging process after a main washing process will now be described. However, the present disclosure is not limited thereto, and thus, the method may be performed in a discharging process after a preliminary washing process, a ringing process, or a hot rinsing process.

First, in operation S11, a preliminary washing process may be performed on the dishwasher 1. In operation S11, the preliminary washing process is performed before a main washing process, and may be defined as a process of removing a protein-based waste.

After the preliminary washing process, the main washing process is performed in operation S12. In operations S12 and S13, the main washing process is performed to receive washing water from the outside, mix the received washing water with a detergent supplied from a detergent container (not shown), and supply the mixed washing water to the sump 20.

Then, in operation S14, the washing water pump 70 is driven to spray the washing water from the sump 20 to the washing chamber of the tub 11. In operation S14, the washing water pump 70 may be driven for a preset time to correspond to the main washing process.

When the main washing process is ended in operation S15, the washing water pump 70 is turned off in operation S16. A discharging process in which contaminated washing water is discharged may be performed. The discharging pump 90 is turned on in operation S17.

When the discharging pump 90 is driven, the washing water and a foreign substance are discharged from the sump 20 to the outside through the discharging part 59. Thus, as a driving time of the discharging pump 90 increases, the level of the washing water in the sump 20 decreases.

The driving time of the discharging pump 90 may be measured. In operation S18, it is determined whether the driving time of the discharging pump 90 is greater than a first set time. For example, the first set time may be an elapsed time before the discharging process is completed, and may be about 5 seconds.

When the discharging pump 90 is driven for the first set time, the level of the washing water may be close to the level h1. That is, the level of the washing water incompletely discharged may be positioned under the upper end of the filter housing 51.

When the driving time of the discharging pump 90 is greater than the first set time, the discharging pump 90 is turned off in operation S19. When the driving time of the discharging pump 90 is equal to or smaller than the first set time, the discharging pump 90 is driven in operation S17.

After operation S19, off states of the washing water pump 70 and the discharging pump 90 may be maintained for a certain time (a first off time). For example, the first off time may be about 2 seconds. The first off time may be a time period for stabilizing the level of the washing water after the washing water pump 70 and the discharging pump 90 are turned off.

After that, in operation S20, the washing water pump 70 may be turned on. When the washing water pump 70 is driven, the level of the washing water may be decreased. At this point, the washing water pump 70 may be driven at about 2000 rpm. The off state of the discharging pump 90 is maintained.

While the washing water pump 70 is driven, a driving time of the washing water pump 70 may be measured. In operation S21, it is determined whether the driving time of the washing water pump 70 is greater than a second set time. For example, the second set time may be at least 10 seconds.

After the second set time, the washing water pump 70 is turned off in operation S22. When the driving time of the washing water pump 70 is equal to or smaller than the second set time, the washing water pump 70 is driven in operation S20.

When the washing water pump 70 is turned off, the washing water discharged from the filter part 50 flows backward to the filter part 50. Accordingly, the level of the washing water in the filter part 50 increases. The level of the washing water in the filter part 50 may reach the level h2. That is, since the level of the washing water increases over the upper end of the filter housing 51, a foreign substance trapped in the first filter 52 may be removed from the first filter 52.

The second set time is set such that the level of the washing water flowing backward to the filter part 50 after the turning off of the washing water pump 70 is higher than the top surface of the sump 20, and may correspond to a rising height of the washing water.

For example, if the second set time is too short, the washing water discharged from the washing water pump 70 is insufficiently moved to the washing water guide 40 or the lower nozzle 17, so that potential energy of the washing water may be insufficient.

In this state, even when the washing water pump 70 is turned off, an amount of the washing water flowing backward to the filter housing 51 may be insufficient. Thus, the second set time is set such that the level of the washing water flowing backward to the filter housing 51 reaches the level h2.

While the washing water pump 70 is driven for the second set time, the surface of washing water discharged from the washing water pump 70 to the tub 11, that is, the surface of washing water flowing to the washing water guide 40 or the lower nozzle 17 is higher than the upper end of the sump 20.

In other words, the level of washing water within the washing water guide 40 or the lower nozzle 17 may be higher than the upper end of the sump 20.

The washing water flowing backward to the filter housing 51 may clean the surface of the second or third filter 53 or 54. That is, a foreign substance may be removed from the second or third filter 53 or 54.

After the washing water pump 70 is turned off, an off state of the washing water pump 70 and the off state of the discharging pump 90 are maintained for a certain time (a second off time). For example, the second off time may be about 2 seconds.

After the second off time, it is determined in operation S23 whether operations S16 to S22 are repeated a preset number of times. For example, the preset number of times may be at least three. That is, the washing water pump 70 and the discharging pump 90 may be turned off/on a plurality of times.

When operations S16 to S22 are repeated the preset number of times, the discharging pump 90 is turned on in operation S24. At this point, an on state of the discharging pump 90 is maintained until discharging of the washing water is completed When operations S16 to S22 are not repeated the preset number of times yet, the method is performed from operation S16.

As such, while the washing water pump 70 and the discharging pump 90 are repeatedly turned off/on, the level of the washing water in the filter part 50 is vertically adjusted, thereby removing a foreign substance trapped in the filter part 50.

As a result, before the discharging process is completed, the level of the washing water in the filter housing 51 is adjusted using the washing water pump 70, thereby removing a foreign substance trapped in the first to third filters 52, 53, and 54. After that, while the rest of the discharging process is performed, the removed foreign substance is efficiently discharged together with the washing water.

According to the embodiments, on/off operations of the washing water pump and the discharging pump are controlled during the discharging process after the washing process, to thereby clean the filter.

In detail, the washing water pump is turned on and off to adjust the level of washing water in the filter, thereby removing a foreign substance from the filter.

In addition, since a foreign substance is effectively removed from the filter, washing water efficiently flows, and thus, a dish can be effectively washed.

In addition, since a foreign substance is removed from the filter surface, clogging of the filter can be prevented, and thus, the filter can more efficiently filter a foreign substance from washing water.

In addition, since a foreign substance removed from the filter is discharged out of the dishwasher by the discharging pump, offensive smell due to decay of foreign substance can be prevented.

In addition, a dish can be more efficiently washed, and a foreign substance is effectively discharged, thereby improving the reliability of the dishwasher.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of controlling a dishwasher including a washing chamber accommodating a dish, a sump storing washing water and supplying the washing water to the washing chamber, a filter part provided to the sump and filtering a foreign substance from the washing water and a washing water guide to guide the washing water from the sump to the washing chamber, the method comprising:

driving a first pump to perform a washing or rinsing process;

stopping the first pump and then turning on a second pump for a first set time to perform a discharging process, after the washing or rinsing process;

stopping the second pump and driving the first pump for a second set time; and stopping the first pump after the second set time, wherein, in the stopping of the second pump and the driving of the first pump for the second set time, the second set time is a time elapsed until a level of the washing water in the washing water guide is higher than an upper end of the sump.

2. The method according to claim 1, further comprising maintaining the first and second pumps stopped for a first off time after the stopping of the second pump and prior to the driving the first pump for the second set time.

3. The method according to claim 1, wherein the dishwasher comprises a filter housing accommodating the filter part, wherein the first set time is a time elapsed before washing water stored in the filter housing is completely discharged.

4. The method according to claim 1, wherein the filter part comprises:

a first filter provided to an upper end of the sump;

a plurality of filters provided to a lower side of the first filter; and a filter housing accommodating the filters.

5. The method according to claim 2, further comprising maintaining the first and second pumps stopped for a second off time.

6. The method according to claim 4, wherein, when the first pump is stopped after the second set time, the washing water introduced into the washing chamber flows backward to the first pump.

7. The method according to claim 5, wherein the stopping of the first pump, the turning on the second pump for the first set time, the stopping of the second pump, the driving of the first pump for the second set time, and the stopping of the first pump after the second set time are repeated a preset number of times.

8. The method according to claim 6, wherein the second set time is determined such that a level of the washing water flowing backward through the first pump reaches a level higher than the first filter.

9. The method according to claim 7, wherein the preset number of times is at least three.

10. The method according to claim 7, further comprising driving the second pump until the discharging process is completed, after the present number of times has been repeated.

11. A method of controlling a dishwasher including: a washing chamber accommodating a dish; a sump storing washing water and supplying the washing water to the washing chamber; and a filter part provided to the sump and filtering a foreign substance from the washing water, the method comprising:

driving a first pump to perform a washing or rinsing process;

stopping the first pump and then turning on a second pump for a first set time to perform a discharging process, after the washing or rinsing process;

stopping the second pump and driving the first pump for a second set time; and stopping the first pump after the second set time, wherein the dishwasher comprises a washing water guide to guide the washing water from the sump to the washing chamber, wherein, in the stopping of the second pump and the driving of the first pump for the second set time, the second set time is a time elapsed until a level of the washing water in the washing water guide is higher than an upper end of the sump, and wherein the second set time is at least 10 seconds.

* * * * *